US009037017B2

(12) United States Patent
Suzuki

(10) Patent No.: US 9,037,017 B2
(45) Date of Patent: May 19, 2015

(54) IMAGE FORMING APPARATUS CAPABLE OF CONTROLLING DENSITY OF IMAGE AND CONTROL METHOD THEREFOR

(71) Applicant: CANON KABUSHIKI KAISHA, Tokyo (JP)

(72) Inventor: Shinya Suzuki, Toride (JP)

(73) Assignee: CANON KABUSHIKI KAISHA (JP)

( * ) Notice: Subject to any disclaimer, the term of this patent is extended or adjusted under 35 U.S.C. 154(b) by 44 days.

(21) Appl. No.: 13/803,847

(22) Filed: Mar. 14, 2013

(65) Prior Publication Data

US 2013/0266331 A1 Oct. 10, 2013

(30) Foreign Application Priority Data

Apr. 10, 2012 (JP) ..... 2012-089303

(51) Int. Cl.
*G03G 15/00* (2006.01)

(52) U.S. Cl.
CPC ..... *G03G 15/5041* (2013.01); *G03G 15/5058* (2013.01); *G03G 2215/00599* (2013.01)

(58) Field of Classification Search
USPC ..... 399/49, 38, 60, 138
See application file for complete search history.

(56) References Cited

U.S. PATENT DOCUMENTS 7,917,045 B2 * 3/2011 Yagawara et al. ..... 399/38
8,218,989 B2 * 7/2012 Fujita ..... 399/49
2004/0071370 A1 * 4/2004 Yamazaki ..... 382/312

FOREIGN PATENT DOCUMENTS

JP 2010-009018 A 1/2010

* cited by examiner

*Primary Examiner* — Roy Y Yi
(74) *Attorney, Agent, or Firm* — Rossi, Kimms & McDowell LLP

(57) ABSTRACT

An image forming apparatus which reduces downtime by starting image density detection without waiting for identification of the same position on a rotary member. A detection unit detects a surface condition of a rotary member on which a toner image on a photosensitive drum is transferred. An identifying unit matches first data detected by the detection unit on a reference point on the surface of the rotary member and second data detected by the detection unit after obtainment of the first data to identify the reference point. A control unit controls image density based on a detection result obtained by the detection unit on a base of the rotary member corresponding to a range where a measurement image is formed and an obtained detection result on the measurement image by referring to the reference point identified as a reference.

2 Claims, 13 Drawing Sheets

IMAGE FORMING APPARATUS CAPABLE OF CONTROLLING DENSITY OF IMAGE AND CONTROL METHOD THEREFOR

BACKGROUND OF THE INVENTION

1. Field of the Invention

The present invention relates to a technique of controlling the density of an image in an electrophotographic image forming apparatus.

2. Description of the Related Art

Conventionally, color image forming apparatuses having individual image carriers generally have a function of automatically controlling image density so as to realize accurate color reproduction and tone stability.

In image density control, a plurality of measurement images (patches) are generally formed on an intermediate transfer member, which is a rotary member, while imaging conditions are being changed. The plurality of patches are then detected using an image density detector provided in an image forming apparatus, the amount of attached toner is calculated based on the detection result, and optimum imaging conditions are determined based on the calculation result.

Also, to obtain optimum values for respective ones of multiple types of imaging conditions, multiple types of image density control are generally performed. Here, examples of imaging conditions include conditions such as charge voltage, exposure intensity, and development voltage, as well as look-up table settings for use in converting an input signal from a host into output image data when a halftone image is to be formed. Tone varies with changes in usage environment, usage histories of various consumables, and so on, and hence, to make tone stable at all times, this image density control needs to be performed on a regular basis.

According to detection principles for optical image density detectors, reflected light from a patch or an intermediate transfer member itself in response to light emitted from a light-emitting device is obtained by a light-receiving device, and based on the result, the amount of toner attached to the patch is calculated. Conversion into the amount of attached toner is actually carried out based on the relationship between an output from the light-receiving device when there is a patch on the intermediate transfer member and an output from the light-receiving device when there is no patch on the intermediate transfer member. This is because reflected light from a patch is affected not only by the amount of toner attached but also by the reflectivity of a surface of the intermediate transfer member.

The reflectivity of a surface of the intermediate transfer member varies according to the position of the surface of the intermediate transfer member. Therefore, in order to accurately calculate the amount of attached toner, an output in a case where there is a patch and an output a case where there is no patch need to be obtained at the same position on the intermediate transfer member. Accordingly, in general, a base output VB from the light-receiving device when there is no patch is obtained at a specific position, and after that, the intermediate transfer member is rotated at least one lap, and a patch is formed at the same position to obtain a patch output VP from the light-receiving device. The base output VB corresponds to reflected light from a base of the intermediate transfer member, and the patch output VP corresponds to reflected light from the patch.

It should be noted that methods to identify the same position on the intermediate transfer member include a method in which a mark provided as a reference is detected, and a method in which the circumferential length of the intermediate transfer member is detected. According to the method in which the circumferential length of the intermediate transfer member is detected, the circumferential length is divided by the circumferential velocity (process speed) of the intermediate transfer member to obtain a time period required for a specific position on the intermediate transfer member to rotate one lap. This time period is counted during rotation, and the timing with which the same position comes again is identified.

When the same position on the intermediate transfer member is to be detected, there is a problem that the circumferential length varies with changes in circumferential parts of the intermediate transfer member, atmospheric environments surrounding the image forming apparatus, and so on. Namely, treating the circumferential length as a fixed value causes an error in position identification. Accordingly, a mark provided as a reference or information on the circumferential length needs to be measured on a regular basis so that positional errors can fall inside an allowable range.

According to Japanese Laid-Open Patent Publication (Kokai) No. 2010-9018, an optical density detector is used to detect reflected light from a surface of an intermediate transfer member to obtain waveform data while the intermediate transfer member is being rotated. Then, matching between waveform data detected in the first lap and waveform data detected in the second lap is performed to identify the same position and calculate information on the circumferential length.

However, according to the prior art, when density adjustment control is performed immediately after the circumferential length is detected, the intermediate transfer member has to be rotated at least one lap so as to obtain waveform data for detection of the circumferential length. Thereafter, the intermediate transfer member is further rotated to make at least one lap so as to obtain an output in a case where there is a patch and an output in a case where there is no patch so as to detect image density. Namely, there is a problem that a time period for rotating the intermediate transfer member at least two laps is required.

SUMMARY OF THE INVENTION

The present invention provides an image forming apparatus capable of reducing downtime by starting image density detection in advance without waiting for identification of the same position on a surface of a rotary member, and a control method therefor.

Accordingly, a first aspect of the present invention provides an image forming apparatus comprising a photosensitive drum on which a toner image is formed, a rotary member on which the toner image on the photosensitive drum is transferred, a detection unit configured to detect a surface condition of the rotary member, a forming unit configured to form a measurement image on a surface of the rotary member, an identifying unit configured to match first data detected by the detection unit in a reference point on the surface of the rotary member and second data detected by the detection unit after obtainment of the first data while rotating the rotary member to identify the reference point, and a control unit configured to control image density based on a detection result obtained by the detection unit on a base of the rotary member corresponding to a range where the measurement image is formed and a detection result obtained by the detection unit on the measurement image by referring to the reference point identified by the identifying unit as a reference, wherein the control unit causes the detection unit to start obtaining the detection result on the base of the rotary member corresponding to the range where the measurement image is formed before the identification unit completes identification of the reference point.

Accordingly, a second aspect of the present invention provides a control method for an image forming apparatus having a photosensitive member on which a toner image is formed, a rotary member on which the toner image on the photosensitive member is transferred, a detection unit that detects a surface condition of the rotary member and a forming unit that forms a measurement image on a surface of the rotary member, the method comprising an identifying step of matching first data detected by the detection unit in a reference point on the surface of the rotary member and second data detected by the detection unit after obtainment of the first data while rotating the rotary member to identify the reference point, and a control step of controlling image density based on a detection result obtained by the detection unit on a base of the rotary member corresponding to a range where the measurement image is formed and a detection result obtained by the detection unit on the measurement image by referring to the reference point identified in the identifying step as a reference, wherein in the control step, obtainment of the detection result on the base of the rotary member corresponding to the range where the measurement image is formed by the detection unit is started prior to completion of identification the reference point.

According to the present invention, downtime can be reduced by starting image density detection in advance without waiting for identification of the same position on a surface of the rotary member.

Further features of the present invention will become apparent from the following description of exemplary embodiments (with reference to the attached drawings).

DESCRIPTION OF THE EMBODIMENTS

The present invention will now be described with reference to the drawings showing an embodiment thereof.

Figure 1:
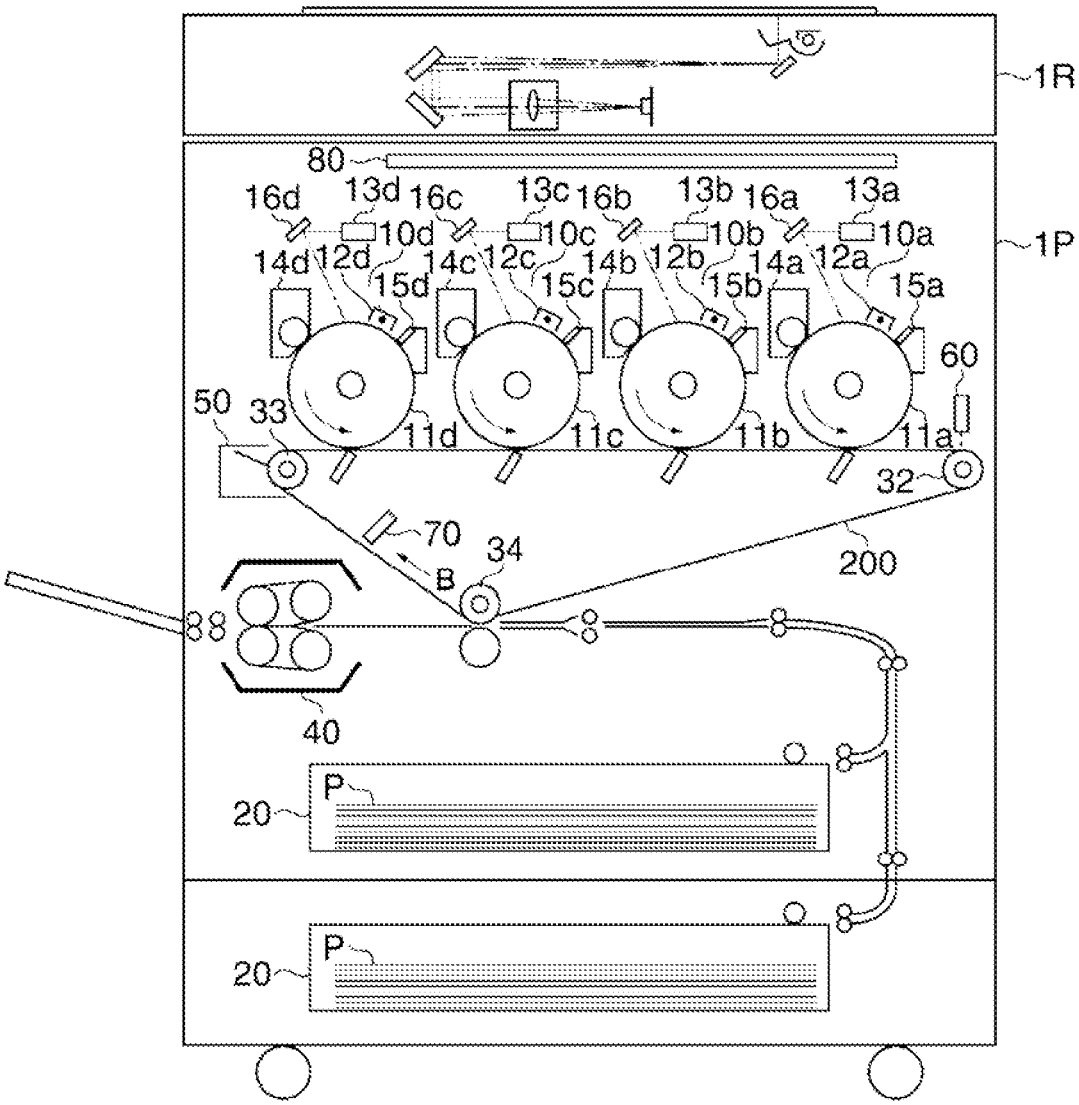
FIG. 1 is a cross-sectional view schematically showing an arrangement of an image forming apparatus according to an embodiment of the present invention.

FIG. 1 is a cross-sectional view schematically showing an arrangement of an image forming apparatus according to an embodiment of the present invention.

This image forming apparatus is an electrophotographic color image forming apparatus in which a plurality of image forming units are disposed in parallel.

This electrophotographic color image forming apparatus is comprised of an image reading unit 1R and an image output unit 1P. The image reading unit 1R optically reads an image off an original, converts the image into an electric signal, and sends the electric signal to the image output unit 1P. The image output unit 1P has a plurality of (in the present embodiment, four) image forming units 10 (10*a* to 10*d*) which are image forming units disposed in parallel, sheet feeding units 20, an intermediate transfer belt 200 which is a rotary member, a fixing unit 40, and cleaning units 50 and 70. The image output unit 1P also has a photo sensor 60 which is a detection unit, and a control unit 80, which is an identifying unit and a control unit.

In the image forming unit 10, photosensitive drums 11*a* to 11*d* which are image carriers are pivotally supported at their centers so as to be rotatable, and they are rotatively driven in directions indicated by arrows. In opposed relation to outer peripheral surfaces of the respective photosensitive drums 11*a* to 11*d*, primary chargers 12*a* to 12*d*, laser scanner units 13*a* to 13*d*, developing devices 14*a* to 14*d*, cleaning devices 15*a* to 15*d*, and reflection mirrors 16*a* to 16*d* are disposed in directions in which the photosensitive drums 11*a* to 11*d* are rotated.

The primary chargers 12*a* to 12*d* apply electrical charges of uniform amount to respective surfaces of the photosensitive drums 11*a* to 11*d*. Then, the laser scanner units 13*a* to 13*d* expose the photosensitive drums 11*a* to 11*d* to light beams such as laser beams, which have been modulated according to a recording image signal from the image reading unit 1R, through the reflection mirrors 16*a* to 16*d*. As a result, electrostatic latent images are formed on the photosensitive drums 11*a* to 11*d*.

Next, the developing devices 14*a* to 14*d* attach developers to the electrostatic latent images formed as described above to form visible images. The visible images thus formed are transferred onto a transfer material P, which is supplied to the photosensitive drums 11*a* to 11*d* via the sheet feeding unit 20, by the intermediate transfer belt 200. The transfer material P is then conveyed to the fixing unit 40, which in turn heats and pressurizes the transfer material P to fix the visible images thereon. The transfer material P with the visible images fixed thereon is discharged from the apparatus, and image formation is brought to an end.

The photo sensor 60 is disposed above the intermediate transfer belt 200 so as to detect density adjustment patterns 203 (to be described later with reference to FIG. 2), which are measurement images formed on the intermediate transfer belt 200. The photo sensor 60 performs identification of the same position in a rotational direction of the intermediate transfer belt 200 (identification of a first reference point P1, to be described later and a reference point P2 in the next lap, to be described later, as the same position) and density detection.

The intermediate transfer belt 200 is supported in a manner being looped over a tension roller 33, a drive roller 32, and an opposing roller 34. While being in contact with the photosensitive drums 11, the intermediate transfer belt 200 is driven by the drive roller 32 to rotate at a predetermined process speed in a direction indicated by an arrow B.

Figure 2:
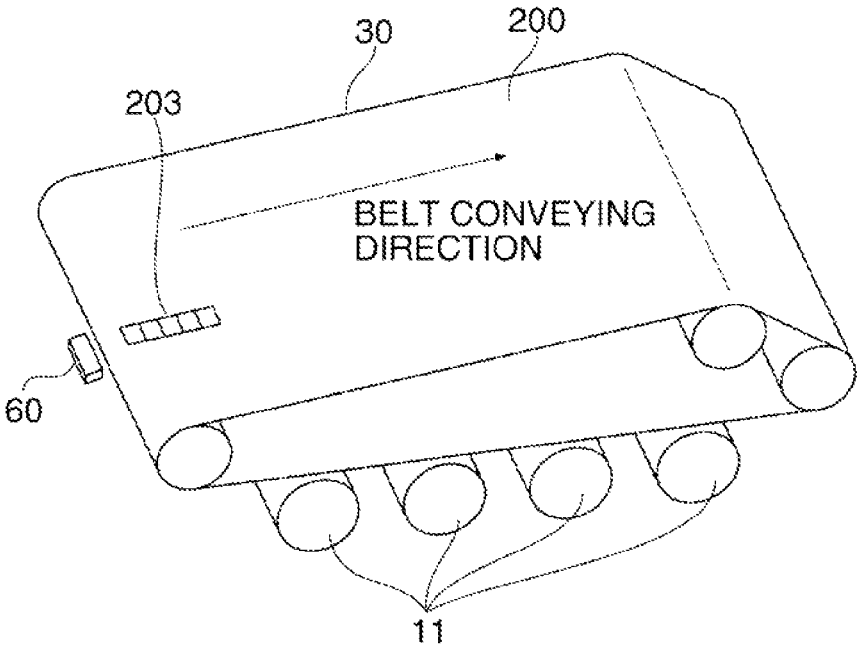
FIG. 2 is a perspective view showing an intermediate transfer belt and its related component elements as viewed from below.

FIG. 2 is a perspective view showing the intermediate transfer belt 200 and its related component elements as viewed from below.

The photo sensor 60 irradiates the intermediate transfer belt 200 with light and detects reflected light from a surface (base) of the intermediate transfer belt 200 or the density adjustment pattern 203 formed on the intermediate transfer belt 200 by the photosensitive drum 11. As a result, the same position on the intermediate transfer belt 200 is identified, and density information is obtained.

Figure 3:
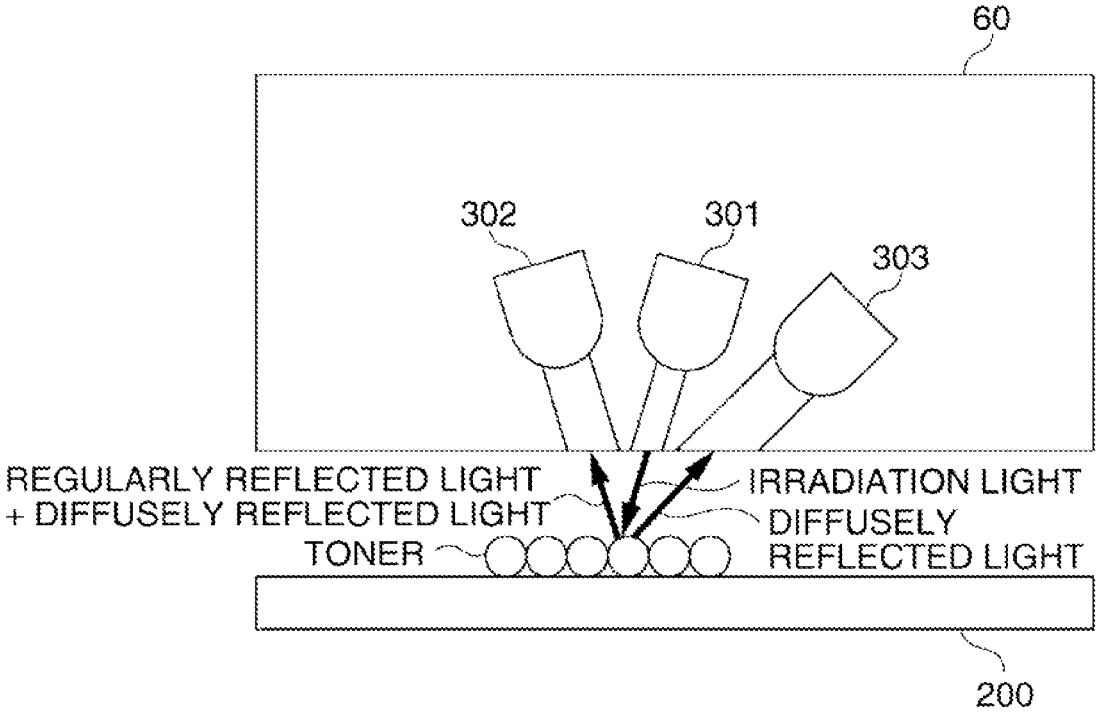
FIG. 3 is a perspective view showing an exemplary photo sensor.

FIG. 3 is a view showing an example of the photo sensor 60. The photo sensor 60 has a light-emitting device 301 such as an LED, two light-receiving devices 302 and 303 such as photodiodes, and a holder. The light-emitting device 301, for example, irradiates the density adjustment pattern 203 (hereafter also abbreviated merely as the "patch") on the intermediate transfer belt 200 or the base with infrared light (with a wavelength of 950 nm). The light-emitting devices 302 and 303 measure the amount of light reflected from the patch or the base.

Light reflected from the patch or the base includes a regularly reflected component and a diffusely reflected component. The light-receiving device 302 detects both a regularly reflected component and a diffusely reflected component, and the light-receiving device 303 detects only a diffusely reflected component. When toner is attached onto the intermediate transfer belt 200, light is blocked by the toner, causing the amount of regularly reflected light to decrease and causing output from the light-receiving device 302 to decrease.

On the other hand, the 950 nm infrared light used in the present embodiment is absorbed by a black toner and diffusely reflected by yellow, magenta, and cyan toners. Thus, as the amount of toner attached to the intermediate transfer belt 200 increases, output from the light-receiving device 303 increases with respect to yellow, magenta, and cyan toners. The light-receiving device 302 is also affected by an increase in the amount of toner attached to the intermediate transfer belt 200. Namely, as for yellow, magenta, and cyan, even when the intermediate transfer belt 200 is completely blocked by toner, output from the light-receiving device 302 does not become zero.

In the present embodiment, the irradiation angle of the light-emitting device 301 is set at 15°, the light-receiving angle of the light-receiving device 302 is set at 15°, and the light-receiving angle of the light-receiving device 303 is set at 45°. These angles are formed by a normal to the intermediate transfer belt 200 and an optical axis. It should be noted that the aperture diameter of the light-receiving device 302 is set smaller than that of the light-receiving device 303. This aims at reducing the effects of a diffusely reflected component to the extent possible. For example, the aperture diameter of the light-emitting device 301 is 0.7 mm, the aperture diameter of the light-receiving device 302 is 1.5 mm, and the aperture diameter of the light-receiving device 303 is 2.9 mm.

A description will now be given of image density adjustment control.

Density adjustment control is to form the density adjustment patterns 203, which are a plurality of patches (toner images), on a trial basis while changing imaging conditions in a non image forming state and detect densities thereof using the photo sensor 60 so that color can accurately be reproduced at any time. It should be noted that here, the non image forming state means a state in which normal image formation in response to a user's request is not being performed. Variations in image density and changes in color reduction become apparent due to changes in electrical characteristics of units and recording materials or the power of attachment to toner according to conditions such as replacement of consumables, environmental change (such as temperature, humidity, and deterioration of the apparatus), and the number of copies. For this reason, density adjustment control is required to be carried out with predetermined timing. Examples of factors that affect image density include a charging bias, a developing bias, an exposure intensity, and a look-up table, and in density adjustment control, image forming conditions are adjusted by correcting some of these factors based on results of detection by the photo sensor 60. In the following description of the present embodiment, for example, image forming conditions are adjusted by correcting a look-up table. A description will be given later of concrete operations in density adjustment control.

Figure 4:
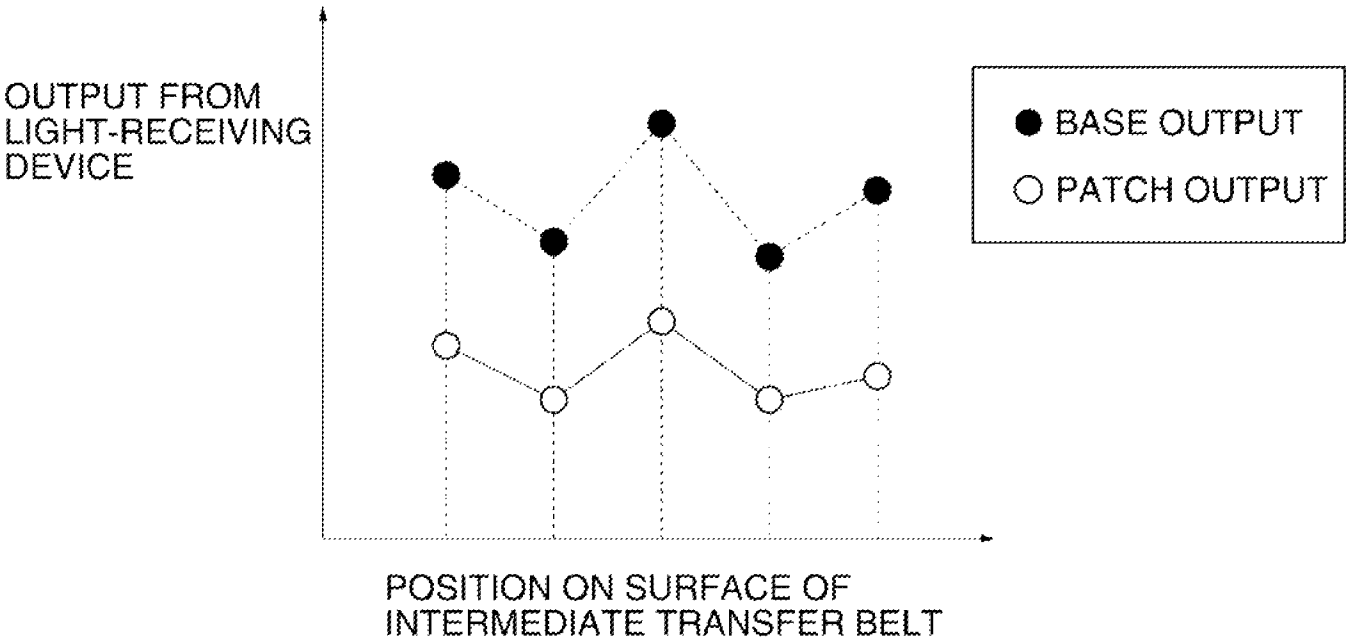
FIG. 4 is a diagram showing exemplary variations in base output and variations in patch output at a plurality of positions on the intermediate transfer belt.

Referring to FIG. 4, a description will now be given of the reason why it is necessary to identify the same position on the intermediate transfer belt 200.

FIG. 4 is a diagram illustrating variations in base output and variations in patch output at a plurality of positions on the intermediate transfer belt 200.

The patches are toner images formed with the same halftone density. A base output is the amount of reflected light detected by the light-receiving device 302 when no patch is formed on the intermediate transfer belt 200. A patch output is the amount of reflected light detected by the light-receiving device 302 with respect to a path formed on the intermediate transfer belt 200. As shown in FIG. 4, an output from the light-receiving device 302 is affected by a surface reflectivity of the intermediate transfer belt 200. For this reason, although patches are formed with the same density, values of patch output differ according to places. The same holds for the light-receiving device 303.

When image density control is carried out in a state of being affected by the reflectivity of a base of the intermediate transfer belt 200, the correlation between density data on a printed halftone and output from the light-receiving device 302 or 303 is small. This reduces the accuracy of image density control. To cancel out the effect of the reflectivity of a base of the intermediate transfer belt 200, it is necessary to measure reflected light detected by the light-receiving device 302 or 303 when there is toner and when there is no toner at the same position on the intermediate transfer belt 200.

On the other hand, the circumferential length of the intermediate transfer belt 200 varies according to manufacturing tolerances, environment, and resistance to sheet feeding through the apparatus (operation of the apparatus for long hours). To measure reflected light detected by the light-receiving device 302 or 303 when there is toner and when there is no toner at the same position on the intermediate transfer belt 200, the same position on the intermediate transfer belt 200 needs to be accurately identified.

Figure 5A:
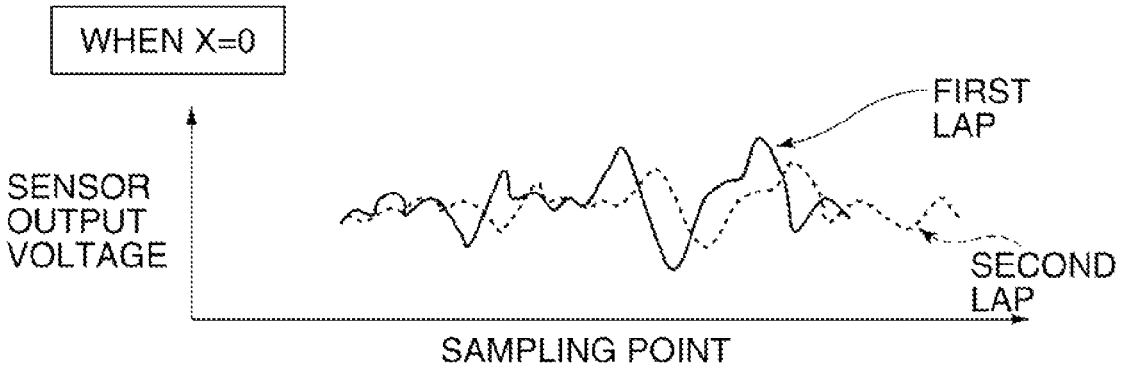
FIGS. 5A to 5C are diagrams showing exemplary relationships between sampling points and sensor output values with respect to two waveform data.
Figure 5B:
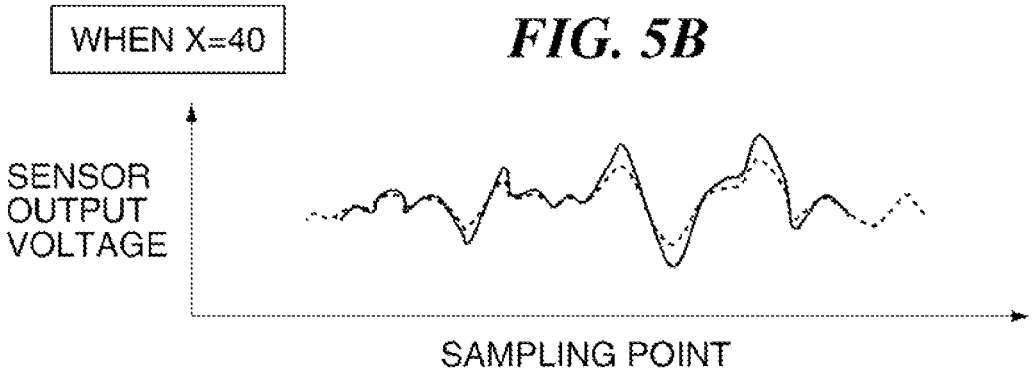
Figure 5C:
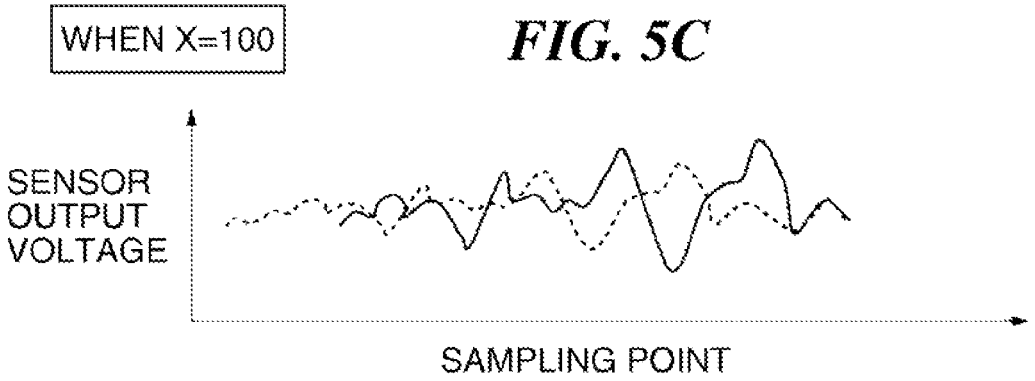

Referring now to FIGS. 5A to 5C, a description will be given of how to identify the same position on the intermediate transfer belt 200. The same position is identified by sampling outputs from the photo sensor 60 when the intermediate transfer belt 200 is rotatively driven. Namely, matching is performed between patterns of two waveform data on a part of a waveform profile in the first lap of the intermediate transfer belt 200 (first data) and a part of a waveform profile in a later lap (for example, the second lap which is the next lap) of the intermediate transfer belt 200 (second data). FIGS. 5A to 5C are diagrams showing exemplary relationships between sampling points and sensor output values with respect to two waveform data.

Based on the waveform data in the first lap (first data), whether or not the waveform data matches is repeatedly determined while sampling points for the waveform data in the first lap (second data) are shifted. Where the amount of shift is X, the waveform data does not match when X=0 and X=1 as shown in FIGS. 5A and 5C. However, as shown in FIG. 5B, the waveform data matches when at X=40.

Specifically, whether or not the waveform data in the first lap and the waveform data in the second lap matches is determined based on a mathematical expression 1 below.

$$I(X)=\Sigma_{i=1}^{1000}|V_{first\ lap}(i)-V_{second\ lap}(i+X)| \quad \text{[Mathematical expression 1]}$$

Here, $V_{first\ lap}(i)$ represents a sensor output value at a point i in the first lap. $V_{second\ lap}(i+X)$ represents a sensor output value at a point i+X in the second lap. I(X) represents a value obtained by integrating absolute values of differences between the waveform data in the first lap and the waveform data in the second lap. The integrated value I(X) represents a difference between the first lap and the waveform data in the second lap and is the shortest when the waveform data matches.

Figure 6:
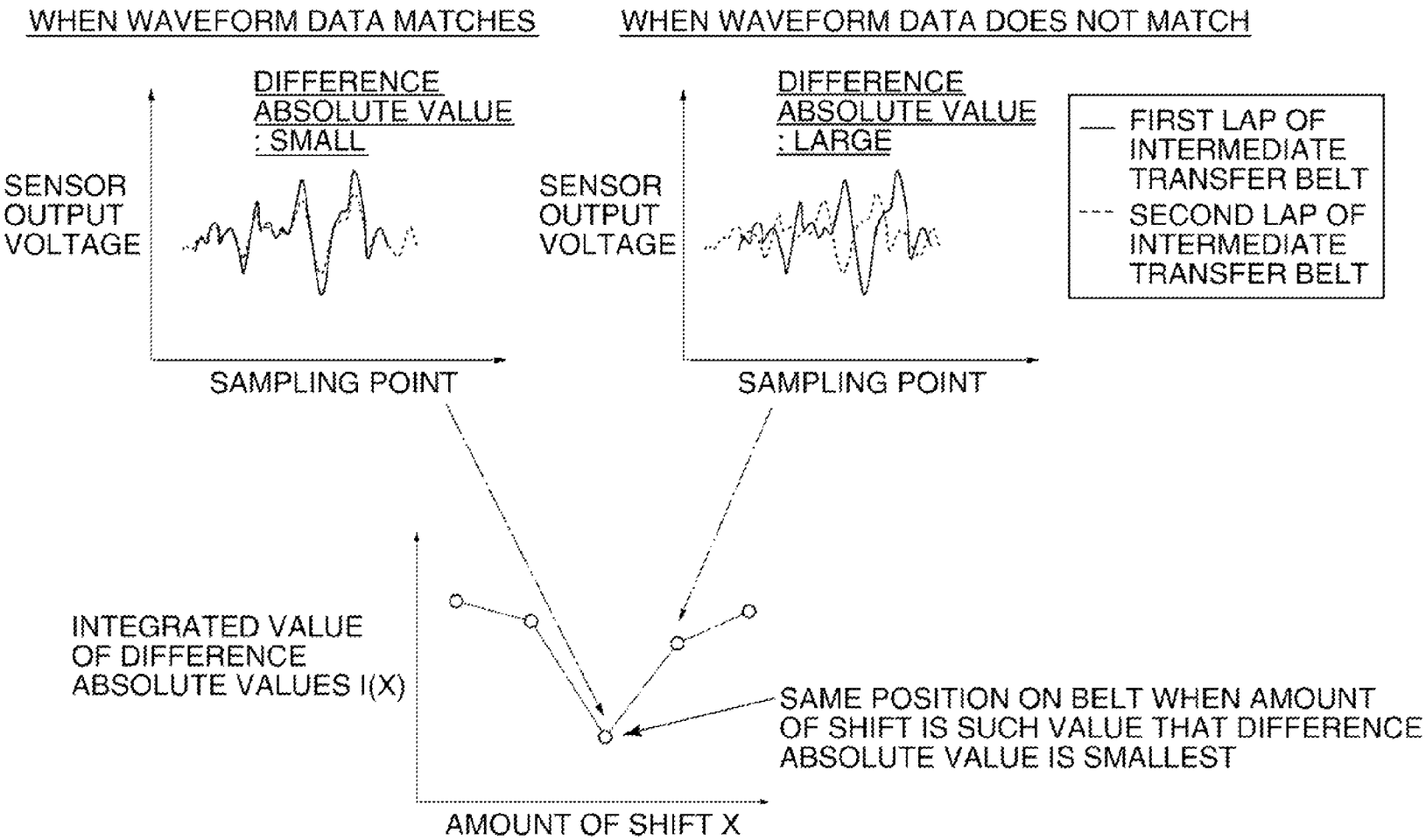
FIG. 6 is a diagram showing the relationship between sensor output and sampling point and the relationship between the amount of shift and integrated value.

FIG. 6 is a diagram showing the relationship between sensor output and sampling point and the relationship between the amount of shift X and integrated value I(X). The value I(X) is calculated with X=0, 1, 2, . . . , and such an amount of shift X that the value I(X) is the smallest is extracted when all the calculations are completed, so that it is possible to know the amount of shift X in the second lap from the first lap, which enables the same position to be detected.

Figure 7:
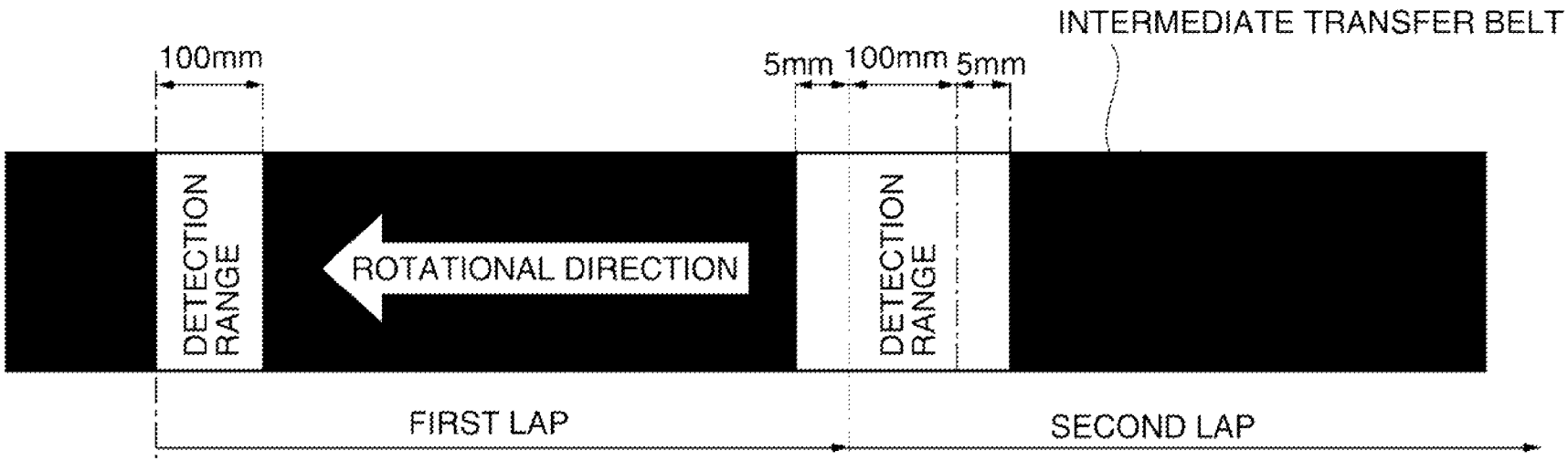
FIG. 7 is a view showing detection ranges on the intermediate transfer belt in chronological order.

Exemplary waveform sampling timing in the first lap and the second lap is illustrated in FIG. 7. FIG. 7 is a view showing detection ranges on the intermediate transfer belt 200 in chronological order. Waveform sampling in the first lap obtains 1000 data at intervals of, for example, 0.1 mm. This corresponds to a length of 100 mm and is about 1/10 of the whole when a normal circumferential length is about 1000 mm. When a process speed (circumferential velocity of the intermediate transfer belt 200) is 100 mm/s, the detection range of 100 mm is 1000 ms in terms of time. The number of data affects the accuracy of position identification. As the number of data increases, the accuracy of matching increases, and on the other hand, the time period required to obtain data also increases, which results in an increase in downtime. Accordingly, the length is set at a minimum length that can realize satisfactory accuracy considering reflectance characteristics of the surface of the intermediate transfer belt 200. It should be noted that measurement start timing in the first lap can be arbitrary timing.

Timing with which sampling in the second lap is started is 5 mm, which corresponds to a half distance of a change in circumferential length, earlier than timing with which the intermediate transfer belt 200 is advanced 1000 mm, which is the nominal value of the circumferential length, from the sampling starting position in the first lap. This start timing is determined so that detection ranges of waveform data in the first lap and waveform data in the second lap can correspond to each other even when the circumferential length changes and becomes the shortest. Likewise, a position at which sampling in the second lap is completed is timing with which the intermediate transfer belt 200 is advanced 5 mm, which corresponds to a half distance of a change in circumferential length, as well as 1000 mm, which is the nominal value of the circumferential length, from a position at which sampling in the first lap is completed.

Figure 8A:
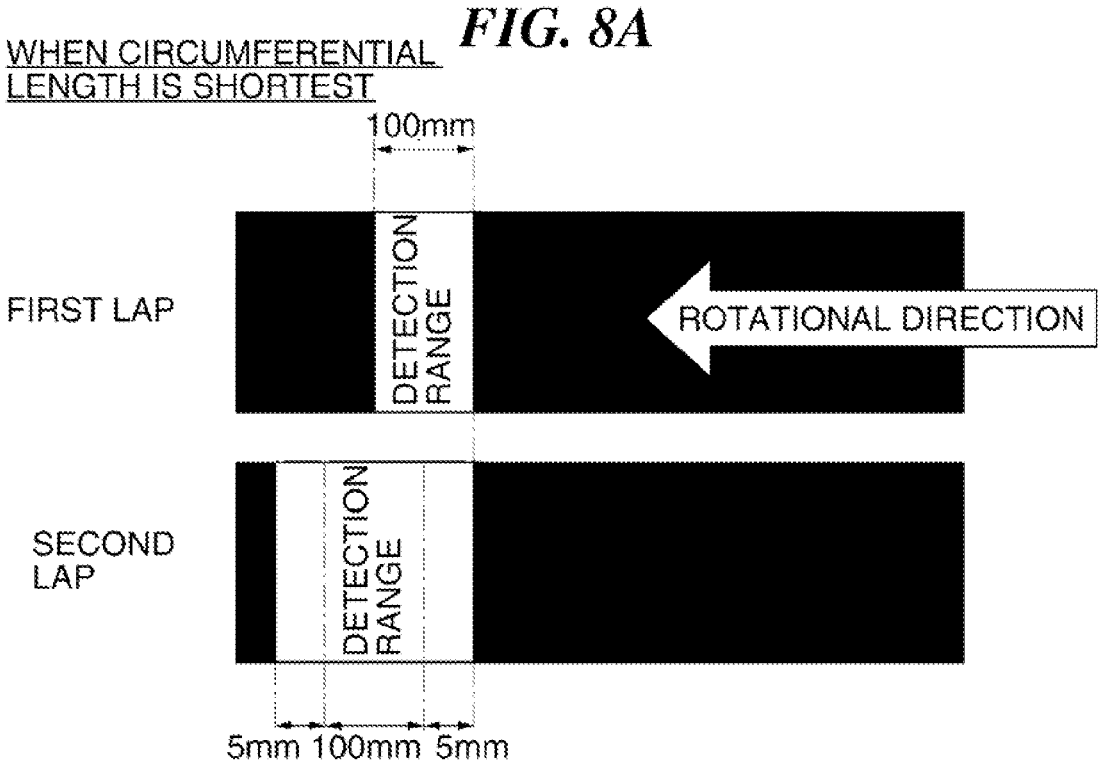
FIGS. 8A and 8B are views showing in detection timing between the first lap and the second lap in cases where circumferential length is the shortest and the longest.
Figure 8B:
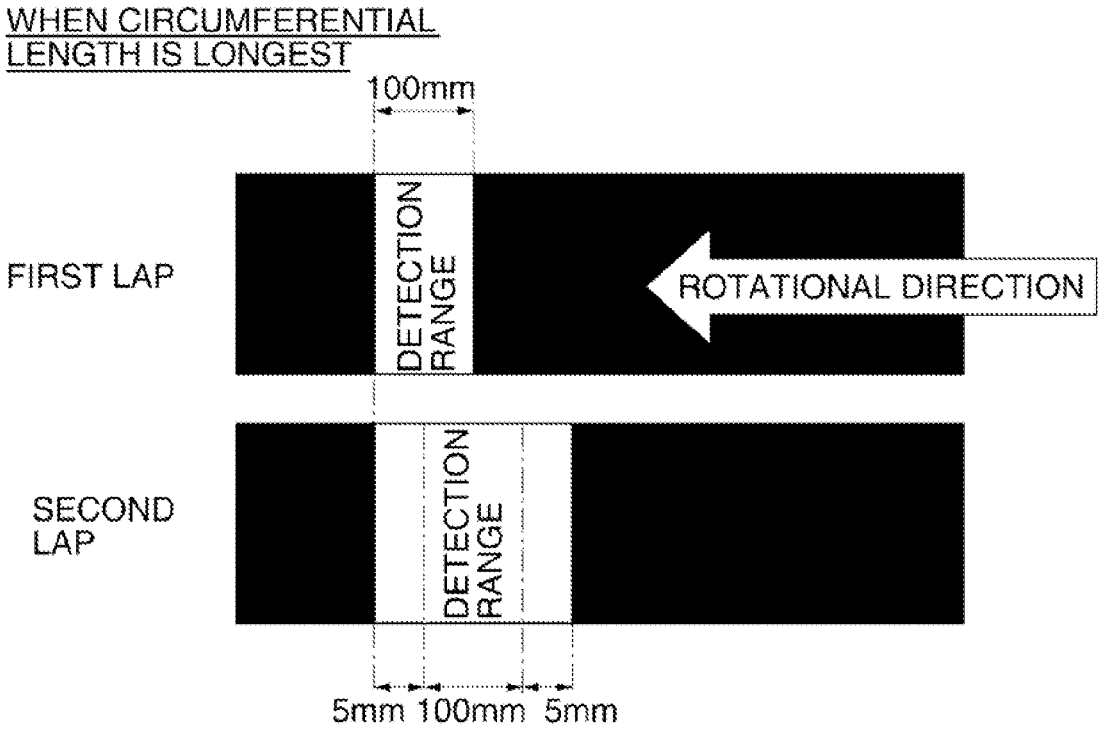

FIGS. 8A and 8B are views showing the relationship in detection timing between the first lap and the second lap in cases where circumferential length of the intermediate transfer belt 200 is the shortest and the longest. Because a sampling time period in the second lap is set longer with margins of 5 mm before and after that, waveform data in the second lap always overlaps waveform data in the first lap even when the circumferential length changes to the greatest degree.

Thus, when the second waveform data is to be obtained, at least a part of a surface of the intermediate transfer belt 200, which was targeted for detection when the first waveform data was obtained, is targeted for detection. For example, sampling data is 1000 data when the first waveform data is obtained, and 1100 data covering this range when the second waveform data is obtained.

Figure 9:
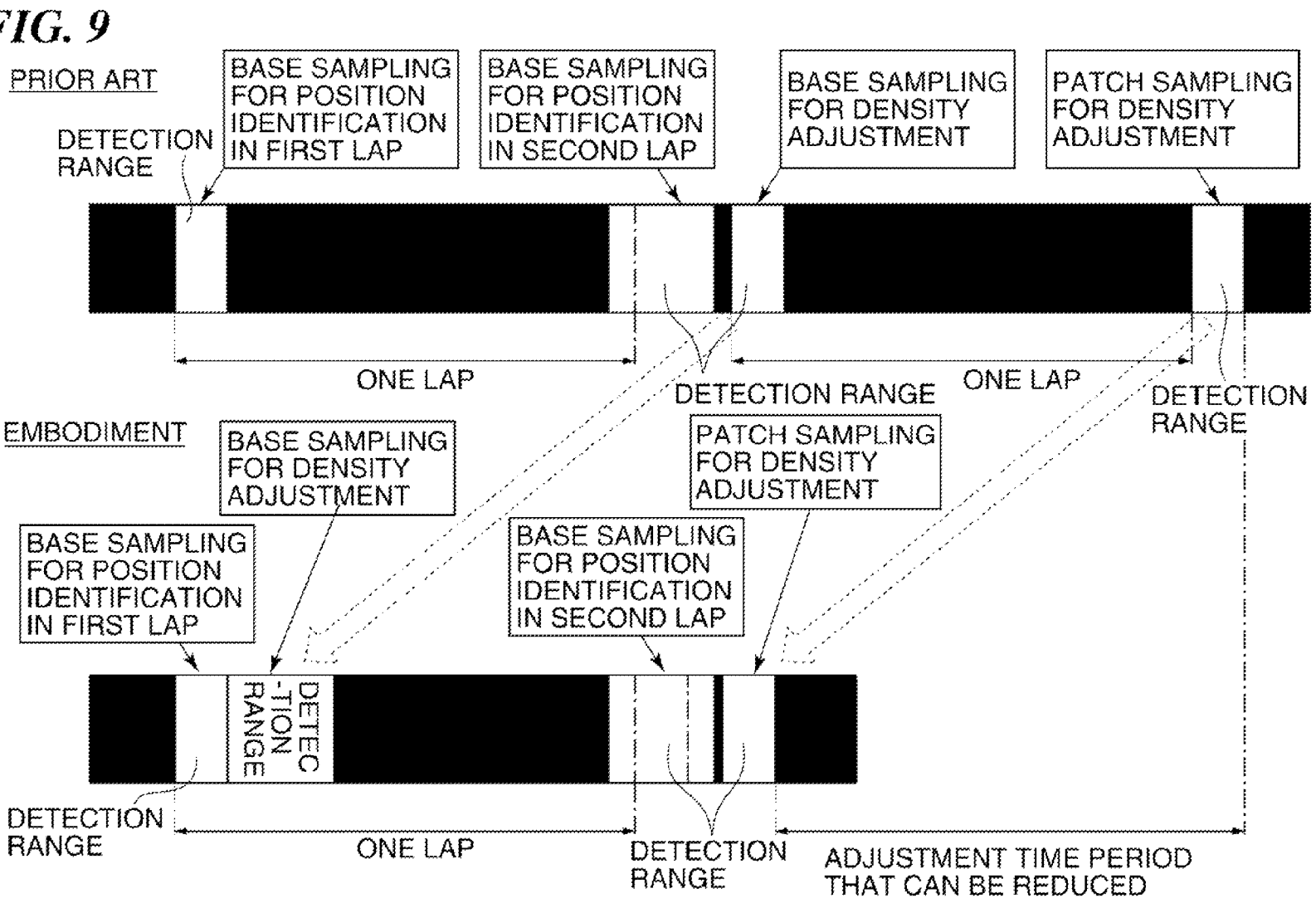
FIG. 9 is a view showing sampling timing in a case where detection for position identification and detection for density adjustment are performed according to the prior art and the present embodiment.

Referring now to FIG. 9, a description will now be given of sampling timing in a case where detection for position identification and detection for density adjustment are carried out. An upper side of FIG. 9 shows a method according to the prior art, and a lower side of FIG. 9 shows a method according to the present embodiment.

According to the prior art, detection for density adjustment is carried out after detection for position identification is completed. Namely, timing of patch sampling for the purpose of detection for density adjustment is determined using information on the circumferential length of the intermediate transfer belt 200 calculated from the result of detection for position identification, and detection for density adjustment is carried out. Specifically, detection for position identification obtains a time period that elapses before the same position is detected when the intermediate transfer belt 200 is rotatively driven, and this information is used for matching a base output and a patch output with each other in density detection.

In this case, as shown in FIG. 9, in order to obtain waveform data in detection for position identification, the intermediate transfer belt 200 needs to be rotatively driven at least one lap. After that, in order to obtain, in detection for density adjustment, an output in a case where there is no patch and an output in a case where there is a patch, the intermediate transfer belt 200 further needs to be rotatively driven at least one lap. Namely, a time period for rotating the intermediate transfer belt 200 at least two laps is always required.

In the present embodiment, as indicated by dotted-line arrows in FIG. 9, the timing with which detection for density adjustment is started is advanced, and base sampling in detection for density adjustment is started before detection for position identification is completed, so that the time period required for adjustment can be reduced. A description will now be given of characteristics of the present invention.

When detection for position identification and detection for density adjustment are to be carried out at the same time, information on the circumferential length should not necessarily be calculated, but it is only necessary to identify reference points which are regarded as the same position in the first lap and a later lap (for example, the second lap which is the next lap). The reference point in the first lap will be referred to as "the first reference point P1", and the reference point in the second lap will be referred to as "the second reference point P2". By identifying and determining the first reference point P1 and the second reference point P2 as the same position on the surface of the intermediate transfer belt 200, the position of the surface of the intermediate transfer belt 200 in the rotational direction is identified.

In relation to detection for density adjustment, a deviation in detecting position between the first lap and the second lap can be eliminated by making "a time period from the first reference point P1 to start of detection" and "a time period from the second reference point P2 to start of detection" equal to each other. These equal time periods are referred to as "the time period T". Further, with allowance made for the amount of shift X, a larger number of waveform samplings for a base are obtained in advance. Namely, a base in a predetermined range wider than the range where a patch is formed is detected in advance.

Therefore, before the second reference point P2 is determined, base data for density adjustment is obtained, and after the second reference point P2 is determined, only data on a necessary part, that is, a range which is the same range is used for computation. Namely, a detection result on a base in a range determined based on the first reference point P1 and the second reference point P2 in a base within a predetermined range is obtained as a base detection result corresponding to the range where a patch is formed.

Base sampling for position identification in the first lap obtains first waveform data for calculating the second reference point P2, and before the second reference point P2 is determined, base sampling for density adjustment is performed. After that, base sampling for position identification in the second lap is performed to obtain second waveform data, which in turn is subjected to a computation in conjunction with the first waveform data in the first lap, so that the second reference point P2 can be calculated and determined.

Figure 10:
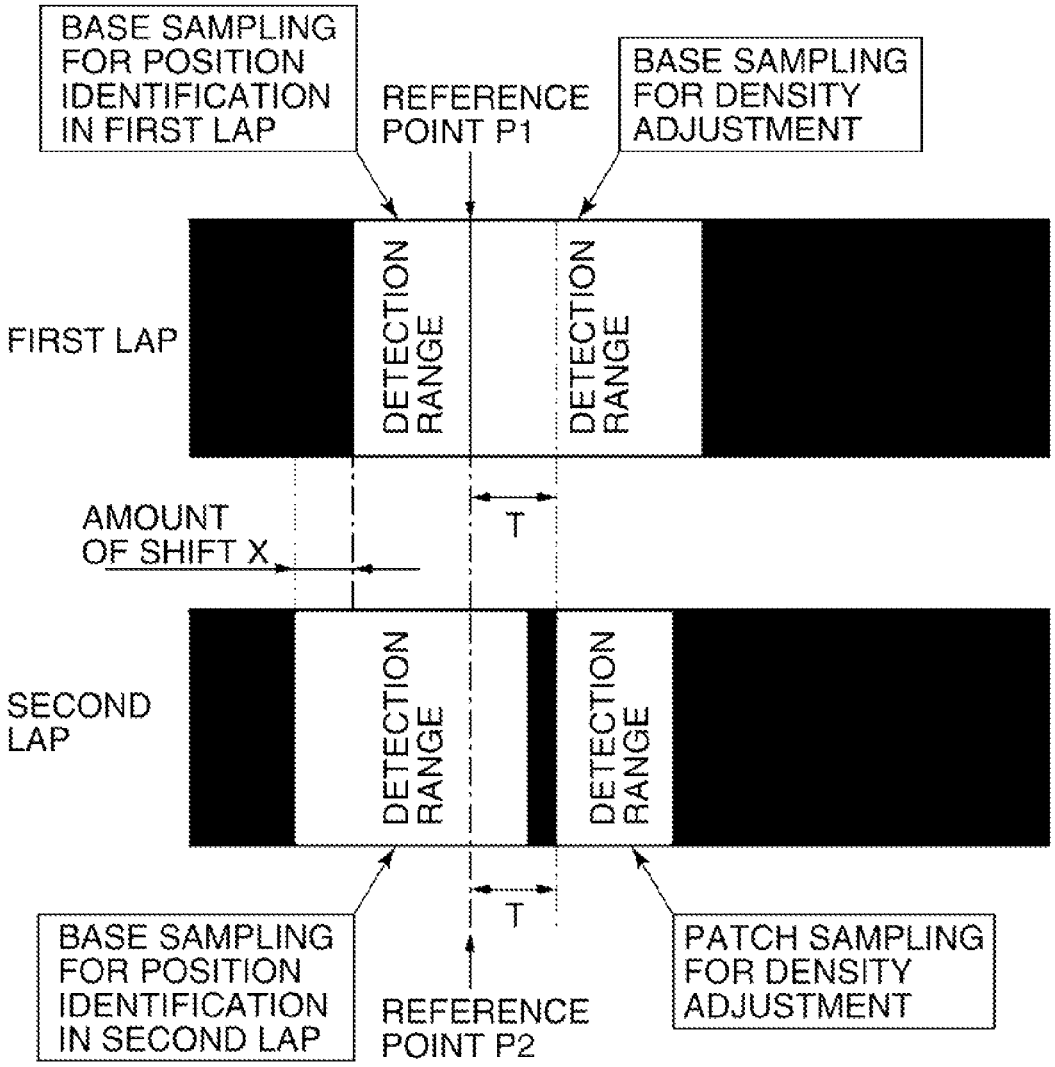
FIG. 10 is a view showing detection ranges in the first lap and the second lap with first and second reference points matched together.

It should be noted that the reference points P1 and P2 may be any positions as long as they are inside a region where the first and second waveform data match. FIG. 10 shows a concrete example.

FIG. 10 is a view showing detection ranges in the first lap and the second lap with the first and second reference points P1 and P2 matched together.

Referring to FIG. 10, for example, timing with which a time period corresponding to the amount of shift X and a time period required for base sampling for position identification in the first lap elapse after timing with which base sampling for position identification in the second lap is started is the second reference point P2 in the second lap. The first reference point corresponding to this is timing with which base sampling for position identification in the first lap is completed. However, a value to be added to the time period corresponding to the amount of shift X in determining the second reference point P2 is not limited to the time period required for base sampling for position identification in the first lap but may be a predetermined time period. Timing with which patch sampling for density adjustment in the second lap is started is timing with which a patch is detected as will be described later (step S117 in FIG. 14).

Time elapsed is counted using a timer, and a time period T that elapses from the second reference point P2 to the timing with which patch sampling for density adjustment is started (the timing with which a patch is detected) is obtained. Values of base sampling for density adjustment for 1000 data after the elapse of the time period T from the first reference point P1 correspond to values of patch sampling for density adjustment for 1000 data. Namely, values of sampling in the same region can be associated with each other, and hence sampling data in the first and second laps can be associated with each other with no deviation in detecting position.

Timing of detection for density adjustment needs to be set so as not to overlap timing of detection for position identification. In both detection for position identification and detection for density adjustment in the first lap, base output is detected, whereas in detection for position identification in the second lap, a base is detected, and in detection for density adjustment in the second lap, a patch needs to be detected. Thus, a base for density adjustment and a patch for position identification cannot be detected at the same time, and they are detected with a time lag.

Base sampling for density adjustment in the first lap obtains 1120 data at intervals of 0.1 mm as a predetermined range. This is because data required to detect a patch is set at 1000 data (100 mm), a variation in circumferential length is set at 100 data (10 mm), and a deviation of laser writing position in image formation is set at 20 data (2 mm). On the other hand, when a patch is to be formed, the patch may be formed at a position deviated from a nominal value due to the effect of a deviation in laser writing position in image formation. For this reason, with consideration given to a value of this positional deviation, a time period for base sampling for density adjustment in the first lap needs to be longer.

Figure 11A:
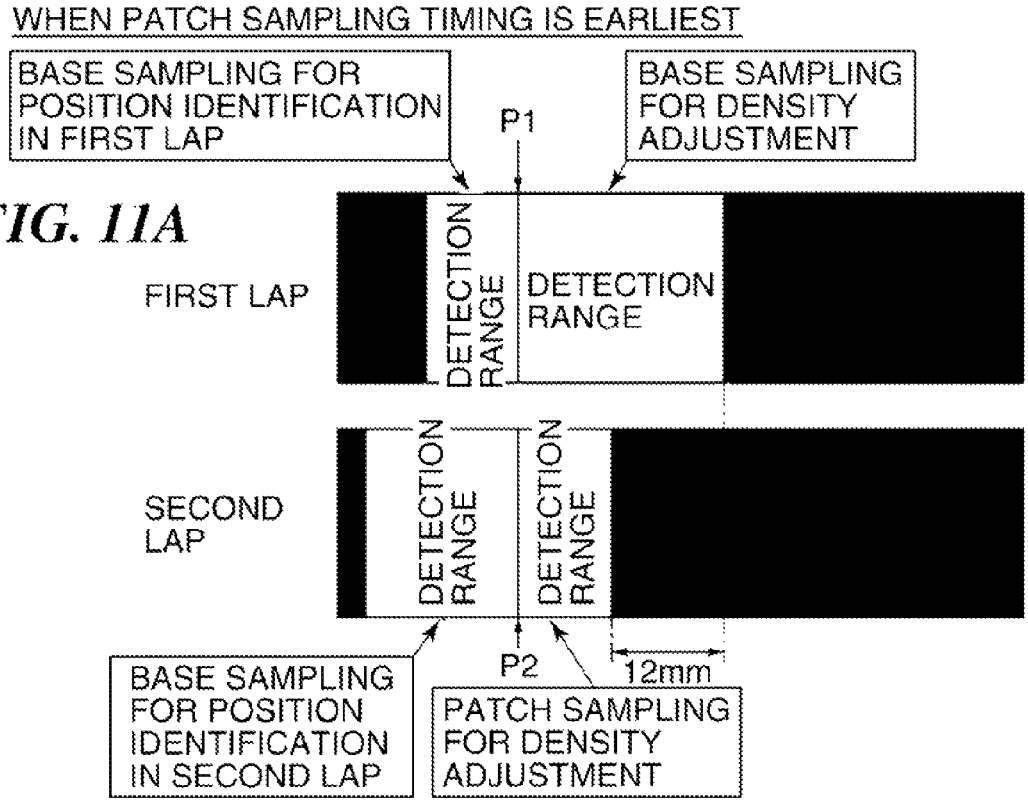
FIGS. 11A and 11B are views showing timing of patch sampling for density adjustment.
Figure 11B:
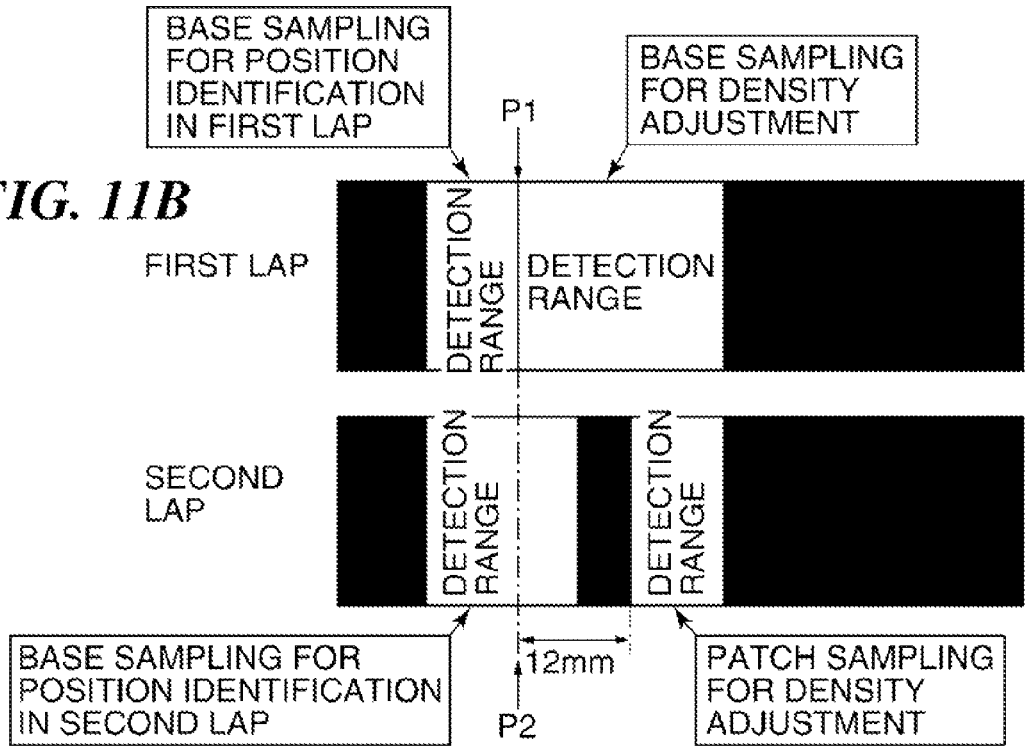

A description will now be given of exemplary timing of patch sampling for density adjustment. FIG. 11A shows an exemplary case where the timing is the earliest, and FIG. 11B shows an exemplary case where the timing is the latest.

When the circumferential length of the intermediate transfer belt 200 is the shortest, and the laser writing position in image formation is shifted to the advanced side to the greatest degree in the rotational direction, the patch sampling timing is the earliest. On the other hand, when the circumferential length of the intermediate transfer belt 200 is the longest, and the laser writing position in image formation is shifted to the receded side to the greatest degree in the rotational direction, the patch sampling timing is the latest.

In either case, the range of density adjustment base sampling and the range of density adjustment patch sampling need to be matched together. For this reason, the base sampling section is set 12 mm longer than the patch sampling section with consideration given to the maximum variation of 10 mm in circumferential length and the maximum deviation of 2 mm in laser writing position.

Figure 12:
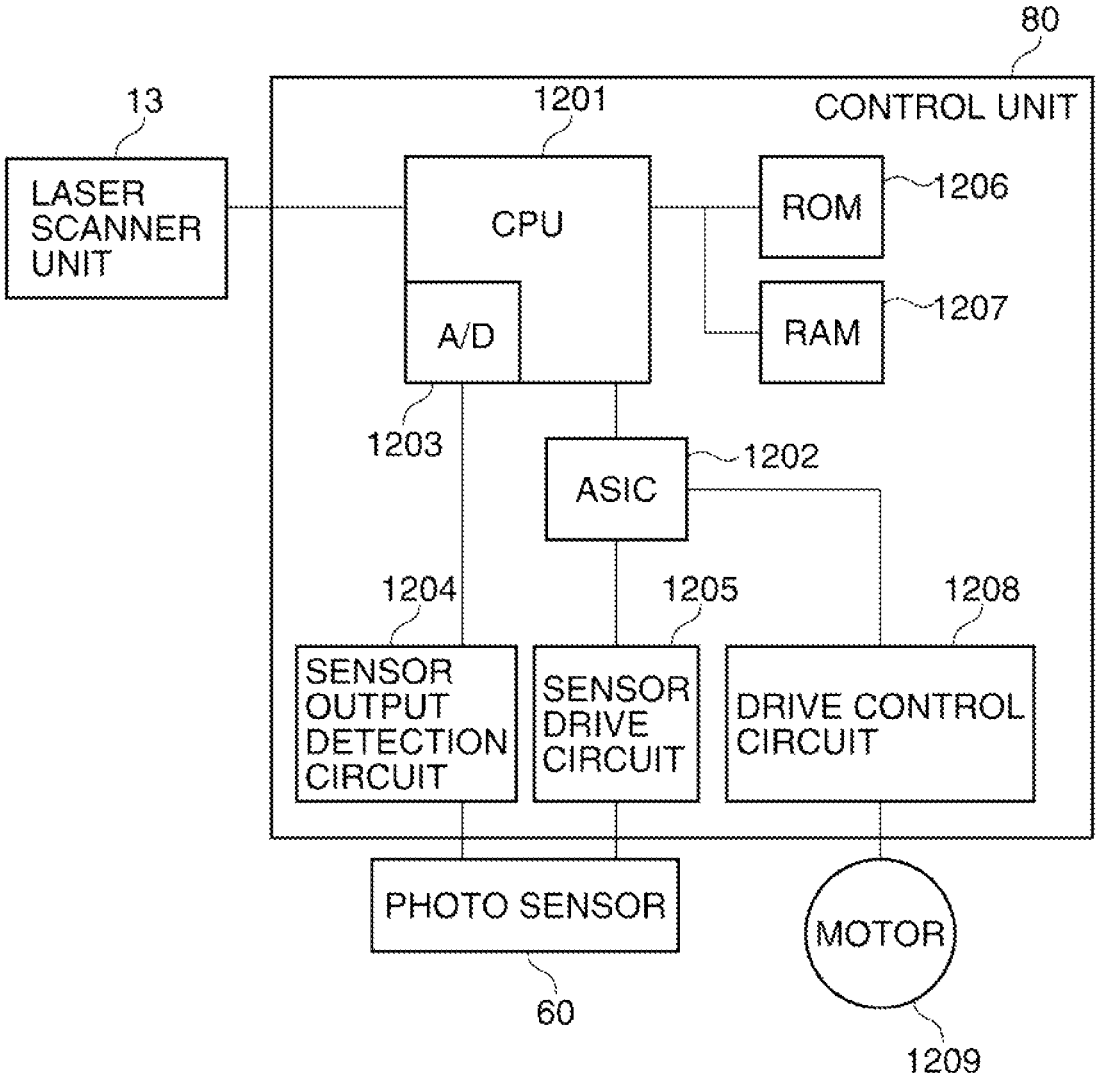
FIG. 12 is a block diagram schematically showing an internal arrangement of a control unit.

FIG. 12 is a block diagram schematically showing an internal arrangement of the control unit 80.

A CPU 1201 implemented on the control unit 80 drives a motor 1209 via an ASIC 1202 and a drive control circuit 1208 to rotate the intermediate transfer belt 200 when carrying out image formation, density adjustment control, and so on. At the time of identifying positions on the intermediate transfer belt 200 or carrying out density adjustment control, the CPU 1201 sends a signal to the photo sensor 60 via the ASIC 1202 and a sensor drive circuit 1205. Then, the photo sensor 60 radiates light in response to the signal and detects reflected light from a base of the intermediate transfer belt 200 or the density adjustment pattern 203. The detected light from the photo sensor 60 is I-V converted, and a sensor output detection circuit 1204 sends the signals to an A/D converter 1203 of the CPU 1201. The A/D converter 1203 captures the signals from the sensor output detection circuit 1204 in chronological order.

The CPU 1201 performs computations based on the A/D-converted information using arithmetic expressions stored in advance in a ROM 1206 to identify the same position on the intermediate transfer belt 200 and calculate density correction information. Based on the calculated density correction information, the CPU 1201 determines setting values for the look-up table and overwrites (updates) values that are stored in a RAM 1207 in advance. At the time of image formation, the CPU 1201 reads out values of the look-up table from the RAM 1207 and sends a signal to the laser scanner unit 13 under conditions suitable for settings, causing an image to be formed.

Figure 13:
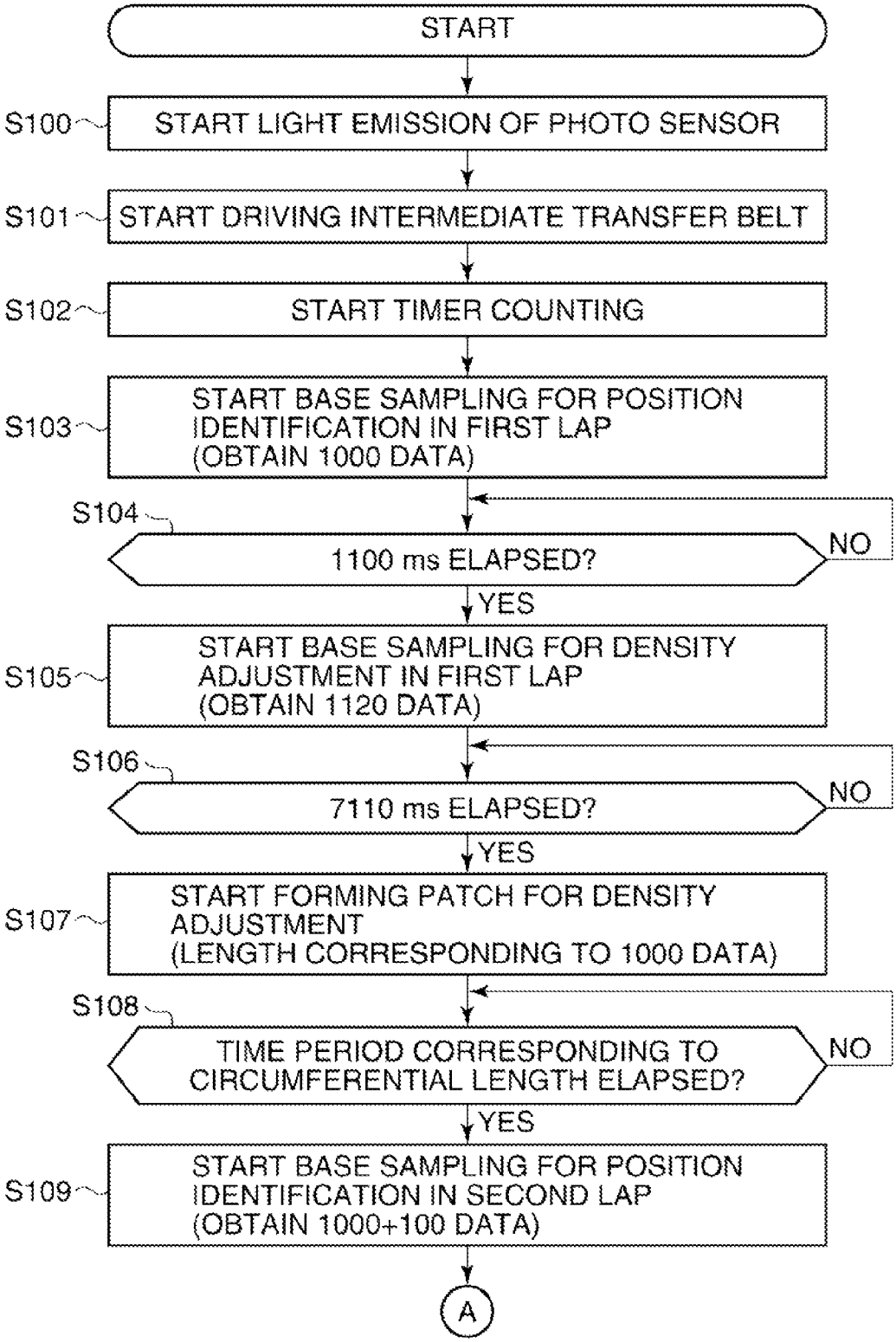
FIG. 13 is a flowchart of density adjustment control.
Figure 14:
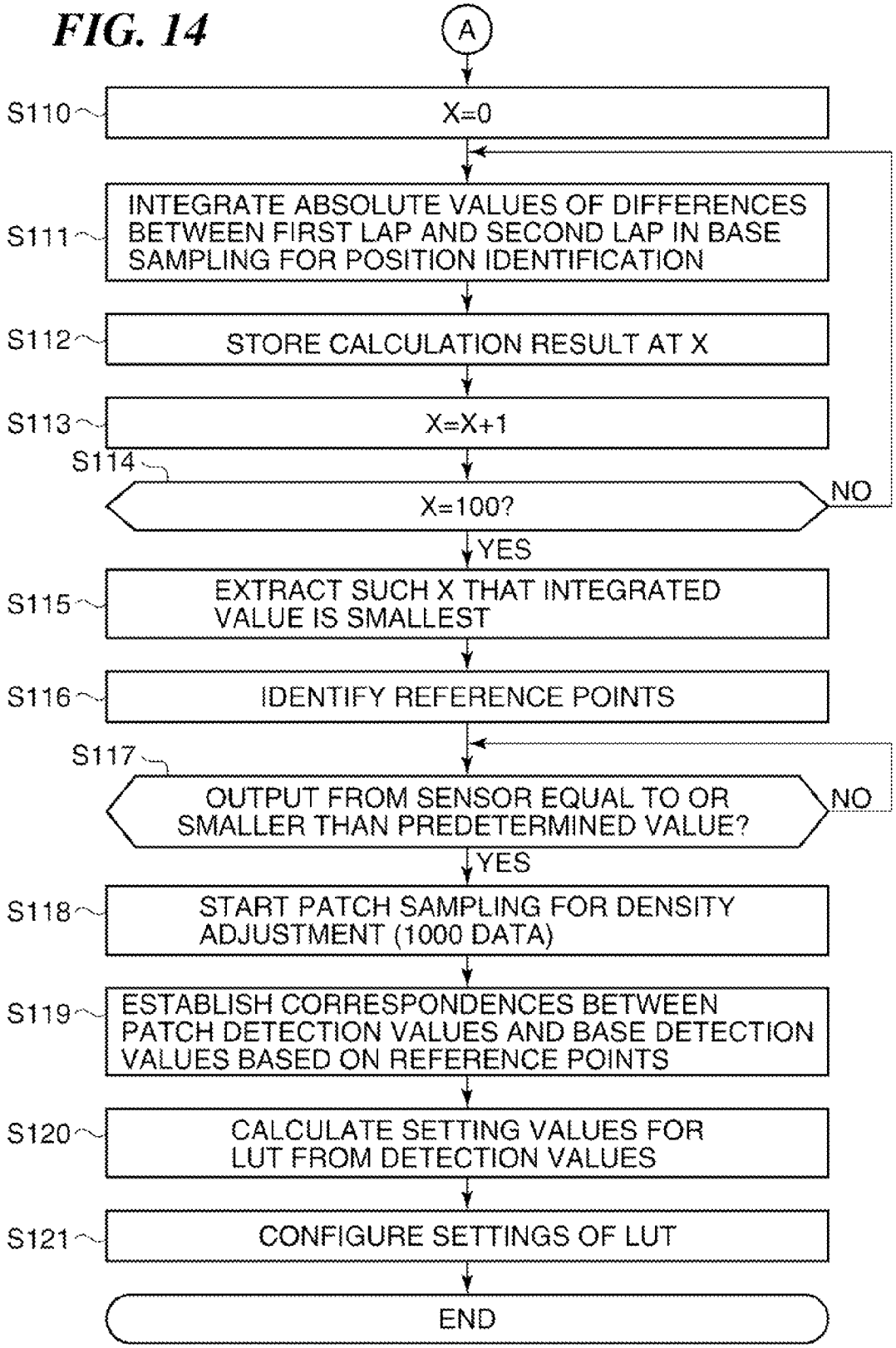
FIG. 14 is a flowchart of density adjustment control continued from FIG. 13.

Referring next to FIGS. 13 and 14, a description will be given of image density adjustment control performed by the CPU 1201. FIGS. 13 and 14 are flowcharts of image density adjustment control.

When image density adjustment control is started, the CPU 1201 sends a signal to the photo sensor 60, which in turn radiates light (step S100). The CPU 1201 then sends a signal to the motor 1209, which in turn causes the intermediate transfer belt 200 to rotate (step S101). The CPU 1201 then starts counting by a timer which it has (step S102) and starts position identification base sampling for 1000 data in the first lap of the intermediate transfer belt 200 (step S103). Sensor output values at respective sampling points are stored as a first-lap waveform profile (first waveform data) in the RAM 1207.

When the timer counts 1100 ms after the start of position identification base sampling (step S104), the CPU 1201 starts density adjustment control base sampling for 1200 data corresponding to a predetermined range (step S105). Thus, obtainment of a detection result on a base of the surface of the intermediate transfer belt 200 which corresponds to the range where a patch is formed is started during identification of the reference points P1 and P2 as the same position. Here, the reason why density adjustment control base sampling is started upon the lapse of 1100 ms, not 1000 ms, is that detection timing for position identification and detection timing for density adjustment control can be reliably inhibited from overlapping each other.

The timing with which formation of a patch is started is the timing with which an area (range) where density adjustment base sampling has been performed reaches an image formation position, that is, a transfer position of the photosensitive drum 11. This can be calculated from a time period it takes for the intermediate transfer belt 200 to advance from a detecting position of the photo sensor 60 to the transfer position of the photosensitive drum 11. Assuming that this distance is 600 mm, the time period is 6000 ms because the process speed is 100 mm/s. The patch formation start timing corresponds to a time point 7110 ms obtained by adding, to this value, the count value of 1100 ms elapsing until density adjustment base sampling is started and 10 ms that is half the maximum amount of shift in laser writing position.

Thus, at the time point 7110 ms has elapsed (step S106), the CPU 1201 controls the image forming unit 10 to start forming the density adjustment patter 203 for 1000 data (step S107).

Base sampling for position identification for 1100 data in the second lap is started at the time point a time period corresponding to the circumferential length of the intermediate transfer belt 200 elapses after base sampling for position identification in the first lap. Namely, at the time point 9950 ms corresponding to a position 5 mm before a nominal value elapses after base sampling for position identification in the first lap is started (step S108), the CPU 1201 starts base sampling for position identification in the second lap (step S109). Sensor output values at respective sampling points are stored as a second-lap waveform profile (second waveform data) in the RAM 1207.

In the subsequent steps S110 to S116 in FIG. 14, the CPU 1201 carries out a process in which it identifies the first reference point P1 and a second reference point P2 in a later lap on the surface of the intermediate transfer belt 200 as the same position in the rotational direction.

First, the CPU 1201 resets the amount of shift X to zero (step S110). The CPU 1201 then calculates an integrated value I(X) by integrating absolute values of differences between the first lap and the second lap in base sampling for position identification (step S111) and stores (saves) the calculated integrated value I(X) in the RAM 1207 (step S112).

The CPU 1201 then increments the value of the amount of shift X (step S113) and determines whether or not the amount of shift X has become equal to 100 (whether or not X=100) (step S114). The CPU 1201 repeatedly carries out the processes in the steps S111 to S114 until X=100, and calculates integrated values I(X) corresponding to all values of X until the amount of shift X becomes equal to 100.

When the amount of shift X becomes equal to 100, the CPU 1201 determines (extracts) such an amount of shift X that an integrated value I(X) is the smallest among a plurality of integrated values I(X) (step S115). This amount of shift X is the value of the amount of shift when the first and second waveform data match.

Then, based on the amount of shift X when the first and second waveform data match, the CPU 1201 identifies the reference points P1 and P2 in the first and second laps (step S116). Here, as described earlier, the second reference point P2 is identified as timing with which a time period corresponding to the amount of shift X and a time period (1000 ms) required for base sampling for position identification in the first lap elapse after timing with which base sampling for position identification in the first lap is started. The first reference point P1 is timing with which base sampling for position identification in the first lap is completed, and the first reference point P1 and the second reference point P2 are identified as the same position.

Then, the CPU 1201 determines whether or not a patch has been detected based on whether or not an output from the photo sensor 60 has become equal to or smaller than a predetermined value (step S117). When a patch is detected, the CPU 1201 starts patch sampling for density adjustment for 1000 data (step S118).

In step S119 and subsequent steps, based on the first reference point P1 and the second reference point P2, the CPU 1201 establishes correspondences between results of base detection and results of patch detection within a range corresponding to the range where a patch is formed, and based on the correspondence result, controls image density.

Specifically, first, among 1120 data on base sampling for density adjustment, the CPU 1201 establishes correspondences between 1000 data from elapse of a time period T from the first reference point P1 and data on patch sampling for density adjustment (step S119). Then, based on the association result, the CPU 1201 calculates setting values for a look-up table (LUT) based on a calculating formula stored in advance in the ROM 1206 (step S120).

Then, the CPU 1201 configures the look-up table in the RAM 1207 using the calculated setting values (step S121). Namely, the CPU 1201 updates the look-up table so that for each color, a result of conversion from a detection result in each tone into the equivalent amount of attached toner, the amount of attached toner or image density can be the original value corresponding to each tone. As a result of this update of the look-up table, an image with a set density can be formed on a recording material. After that, the CPU 1201 brings the process in FIG. 13 and FIG. 14 to an end.

In subsequent image formation, the CPU 1201 controls image density by reading out values of the look-up table from the RAM 1207, sending signals to the laser scanner unit 13 according to conditions corresponding to setting values, and causing image formation to be performed.

According to the present embodiment, because image density detection is started in advance without waiting for identification of the same position on the surface of the intermediate transfer belt 200, density adjustment control can be completed earlier than ever before. In particular, the second waveform data is obtained in a lap next to a lap in which the first waveform data is obtained among laps of the intermediate transfer belt 200. Thus, correspondences between base sampling data for density adjustment and patch sampling data for density adjustment can be established before the intermediate transfer belt 200 is rotated two laps. As a result, downtime required for density adjustment control can be reduced.

It should be noted that although the intermediate transfer belt 200 is illustrated as an example of a rotary member to be detected by the photo sensor 60, this is not limitative, but any rotary member may be used as long as it is used for image formation or carries a recording material. Therefore, a conveying belt that conveys a recording material on which a toner image is transferred or the photosensitive drum 11 may be used.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-089303 filed Apr. 10, 2012, which is hereby incorporated by reference herein in its entirety.

What is claimed is:

1. An image forming apparatus comprising:

a rotatably driven endless-shaped image carrier;

an image forming unit configured to form an image on said image carrier;

a sensor configured to irradiate light to said image carrier and output light reception data based on a result of receiving a reflected light from a light irradiation area to which the light is irradiated;

a correction unit configured to correct patch light reception data output from said sensor on a basis of a reflected light from a measurement image formed on said image carrier by said image forming unit, based on correction light reception data corresponding to a reflected light from an area in said image carrier on which the measurement image has been formed;

an adjustment unit configured to adjust image forming conditions for said image forming unit based on the patch light reception data corrected by said correction unit;

an identifying unit configured to identify a time period with which the area on which the measurement image has been formed passes through the light irradiation area, based on a first light reception data output from said sensor during a first time period with which an attention area of said image carrier passes through the irradiation area before said image carrier rotates one lap and a second light reception data output from said sensor during a second time period before the attention area passes through the light irradiation area again until the attention area finishes passing through the light irradiation area after said image carrier rotated one lap; and a determination unit configured to determine the correction light reception data by selecting light reception data corresponding to the time period identified by said identifying unit from among base light reception data output from said sensor between the first time period and the second time period.

2. An image forming apparatus according to claim 1, wherein a time period with which said sensor outputs the base light reception data is longer than a time period with which said sensor outputs the patch light reception data.

* * * * *